US006341506B1

(12) United States Patent
Myers

(10) Patent No.: US 6,341,506 B1
(45) Date of Patent: Jan. 29, 2002

(54) CONTINUOUSLY KNIT TUBULAR HOSIERY GARMENT BLANK AND PANTYHOSE GARMENT FORMED THEREFROM

(75) Inventor: Jonathan Myers, Winston-Salem, NC (US)

(73) Assignee: Sara Lee Corporation, Winstom-Salem, NC (US)

( * ) Notice: Subject to any disclaimer, the term of this patent is extended or adjusted under 35 U.S.C. 154(b) by 0 days.

(21) Appl. No.: 09/918,978

(22) Filed: Jul. 31, 2001

Related U.S. Application Data

(63) Continuation-in-part of application No. 09/195,017, filed on Nov. 18, 1998, now abandoned.

(51) Int. Cl.[7] ..... A41B 11/00
(52) U.S. Cl. ..... 66/189; 66/178 R
(58) Field of Search ..... 66/178 R, 179, 66/180, 181, 182, 183, 178 A, 189; 2/239, 240, 241, 242

(56) References Cited

U.S. PATENT DOCUMENTS 402,202 A * 4/1889 Sutton
2,216,062 A * 9/1940 Williams
2,301,065 A * 11/1942 Mills
2,474,894 A * 7/1949 Gottschalck
2,948,065 A * 8/1960 Gift
3,068,675 A * 12/1962 Payne
3,595,132 A * 7/1971 Safrit ..... 66/27
3,757,354 A * 9/1973 Moody ..... 2/409
3,763,668 A * 10/1973 Williams ..... 66/178 A
4,502,301 A * 3/1985 Swallow et al. ..... 66/178 A
5,016,449 A * 5/1991 Negri ..... 66/54
5,442,564 A * 8/1995 Merlini et al. ..... 364/470.12
5,511,394 A * 4/1996 Shima ..... 66/232
5,606,875 A * 3/1997 Nishitani et al. ..... 66/77

* cited by examiner

*Primary Examiner*—Danny Worrell
(74) *Attorney, Agent, or Firm*—Charles Y. Lackey, Esq.; Kilpatrick Stockton LLP

(57) ABSTRACT

A circularly knit tubular hosiery blank and a garment formed therefrom, the blank having panty, thigh, knee, ankle and foot portions separated from each other by increasing and decreasing diameter graduation portions and a constant number of wales throughout. The blank is thereby configured to conform to the natural shape of the female lower torso and leg with gradually increasing and decreasing diameters to avoid abrupt diameter changes and maintain the integrity of the blank fabric's appearance.

3 Claims, 2 Drawing Sheets

CONTINUOUSLY KNIT TUBULAR HOSIERY GARMENT BLANK AND PANTYHOSE GARMENT FORMED THEREFROM

This is a continuation in part application of application Ser. No. 09/195,017 filed November 18, 1998 now abandoned and entitled "A Continuously Knit Tubular Hosiery Garment Blank and Pantyhose Garment Formed Therefrom."

BACKGROUND OF THE INVENTION

1. Field of the Invention

The invention relates to a seamless knit hosiery blank and a garment formed thereby and more particularly to a contoured blank formed by a plurality of increasing and decreasing diameter portions configuring the blank so that it conforms to the natural shape of the female lower torso and leg.

2. Description of the Prior Art

Pantyhose and hosiery manufacturers have long searched for a construction that would enable leg covering hosiery garments to more precisely conform to the shape of the wearer's lower torso and leg, thus enhancing fit characteristics and garment appearance. Traditionally, some shaping has been possible on fixed needle circular knit hosiery machines through the use of reduced size graduated stitches whereby the top of the blank which conforms to the waist of the pantyhose formed from two such blanks starts at a given maximum diameter opening and then gradually is reduced in diameter as the garment is continuously knit toward the toe to thus more precisely fit the leg upper portion and the smaller leg lower portion to the foot. Graduated stitches are generally construed as stitches that have been reduced in stitch length, thus removing yarn from each course that utilizes the smaller stitches. While this technique has been for the most part effective to provide a garment with good fit characteristics through the tapering process in conjunction with the use of stretch yarn, there is still a desire to develop a technique to fully configure such a garment to both decrease and selectively increase the blank and garment made therefrom diameter where the lower torso and leg follows such a general shape. It is to this need that the present invention is directed.

SUMMARY OF THE INVENTION

The present invention is for a circularly knit constant wale tubular hosiery blank having panty, thigh, knee, ankle and foot portions which are selectively separated by increasing and decreasing diameter graduation portions to configure the blank to conform to the natural shape of a female lower torso and leg. The blank for a pantyhose garment utilizing two such blanks joined together is usually knit starting at the welt or waist portion and then extending downwardly through the upper panty portion, the lower panty portion, the thigh portion, the knee portion, the ankle portion and finishing at the foot portion with the diameter of the tubular blank decreasing by the use of graduated stitches throughout the length. In the present invention, the blank is started at an upper panty portion on all of the needles of the machine, thus having a fixed number of wales and a constant diameter, and then extends to a panty graduation portion of increasing diameter, then to a lower panty/upper boot portion of constant diameter and thereafter to the thigh graduation portion having a decreasing diameter. Formation of the knee with a constant diameter follows with a lower leg graduation portion of decreasing diameter connecting the knee portion to an ankle portion of constant diameter. A final instep graduation portion extends to a formed foot portion of constant diameter. Thus, the blank experiences selectively positioned areas of at least two graduation portions of increasing diameter and two graduation portions of decreasing diameter. The number of needles and resulting wales remains the same throughout the blank.

In the panty graduation portion of increasing diameter mentioned earlier, the panty graduation portion of increasing diameter has been developed to provide additional yarn and fabric in the lower panty portion and crotch area to reduce the yarn and fabric stress at that location and thereby making the garment more comfortable to wear. Yarn and fabric stress in this location occurs because the provision of the U-shaped seam to join the blanks together, either with or without a gusset, reduces the amount of fabric in each of the blanks as they are sewn together. Providing a panty graduation portion of increasing diameter proximate that area replaces this lost fabric and reduces the stress to which the yarn and fabric is subjected when no increased diameter graduation is employed.

From this summary, it can be seen that a primary objective of the present invention is to provide a hosiery blank and garment made therefrom having superior fit and appearance characteristics brought about by the selective use of graduation stitches during the knitting process.

Another objective of the present invention is to provide a pantyhose garment utilizing two identically formed circularly knit tubular blanks which, when joined, form a panty portion and individual leg and foot portions. Additional fit characteristics can be provided by including a gusset of appropriate size along the juncture line formed when the tubular blanks are slit and sewn together along their slit edges.

Thus, there has been outlined in summary form, the more important features of the invention in order that the detailed description that follows may be better understood and in order that the present contribution to the art may be better appreciated. There are obviously additional features of the invention that will be described hereinafter and which will form the subject matter of the claims appended hereto. It is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the present invention. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings and descriptive matter in which like characters of reference designate like parts throughout the several views.

DETAILED DESCRIPTION OF THE PREFERRED EMBODIMENT

In describing the present inventive concept, the term "diameter" is used to reflect the distance between one edge of a flattened uncut tubular blank to the other edge. While this is standard terminology in the industry, it is to be understood that the reference to "diameter" also refers to the diameter of the garment if the two blanks are joined together.

Figure 1:
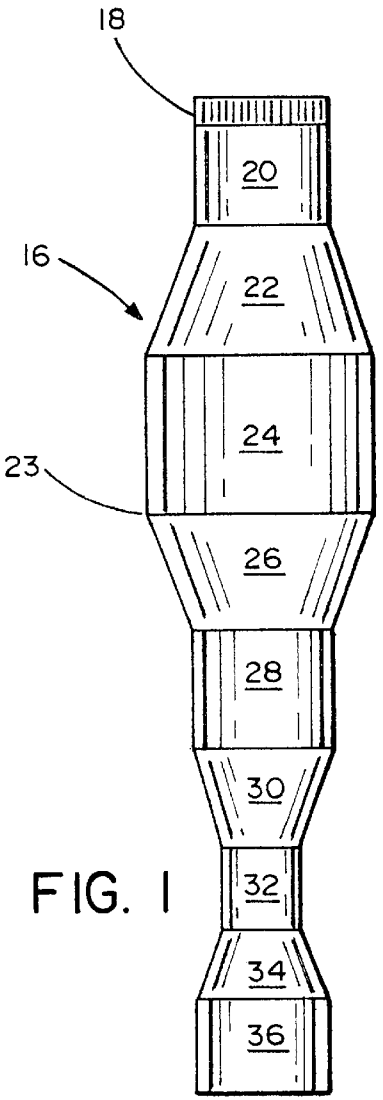
FIG. 1 is a frontal view of the hosiery blank comprising the invention, illustrating in emphasized fashion the selective inclusion of a plurality of graduation portions of increasing and decreasing diameter separating the panty, boot, knee, ankle and foot portions.
Figure 2:
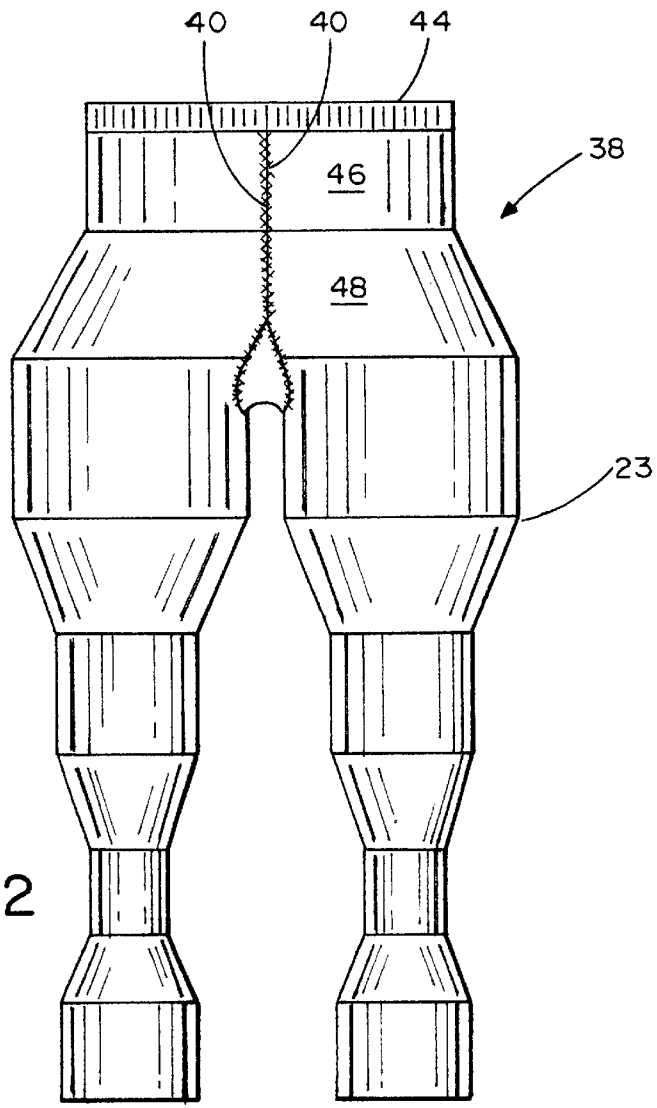
FIG. 2 is a frontal view of a pantyhose garment comprising the present invention formed by joining two hosiery blanks like that shown in FIG. 1.

Prior to describing the present invention in detail, reference is made to the blank shown in FIG. 1 and generally designated 16 and to the application of typical prior art practices. Blank is intended to be one which is to be paired with another blank of similar construction, slit and seamed along paired slit edges and formed into a pantyhose garment. According to conventional prior art practice, the blank will likely have a double welt tubular portion of say 144 courses which may be of stretch nylon or of stretch, elastic, or other combination yarns. This is followed by a second tubular portion of the same diameter having somewhere between 700 to 800 courses in a typical case. The measured diameter when measured as a "stretched diameter" might, in a typical case, be about 13 inches. While stitch type may vary, a plain jersey stitch is typically used. At the end of this tubular portion, the garment is narrowed in diameter by the utilization of graduated stitches so that the stitched length utilized in each course is reduced. The graduation stitches continue or selectively stop and recommence at locations down the leg until the smallest diameter area is reached at the ankle and foot portion. The same number of needle-formed wales are used throughout.

During conventional construction, yarn and fabric tension and stress occur in lower panty portion 2 where two blanks 16 are paired because a greater amount of fabric is required to encircle the two upper thigh portions 23 of the legs than is required to encircle the hip portion 48 just before the formation of the legs. This has long been a concern for pantyhose manufacturers since the stress and tension occurs inherently from the manufacturing process wherein a U-shaped seam typically joins paired slit edges of the blanks. Increased stress and tension at this location causes discomfort to the wearer and early failure of the garment. The problem has been a long suffering one since the 1960's commencing with the development and successful promotion of pantyhose garments. Details of improvements resulting from the present invention with this problem follow.

The present invention represents a significant departure from conventional practice and results in a garment having superior fit, comfort and appearance characteristics over those produced by conventional practice. The blank designated 16 (to be paired with an identical blank 16) is commenced with a double welt tubular portion 18 followed by an upper panty portion 20 having a substantially constant diameter $d_1$, Upper panty portion 18 is followed by a graduation portion 22 of increasing diameter $d_2$ until the lower panty/upper boot portion 24 having a constant diameter $d_3$ is commenced.

Figure 3:
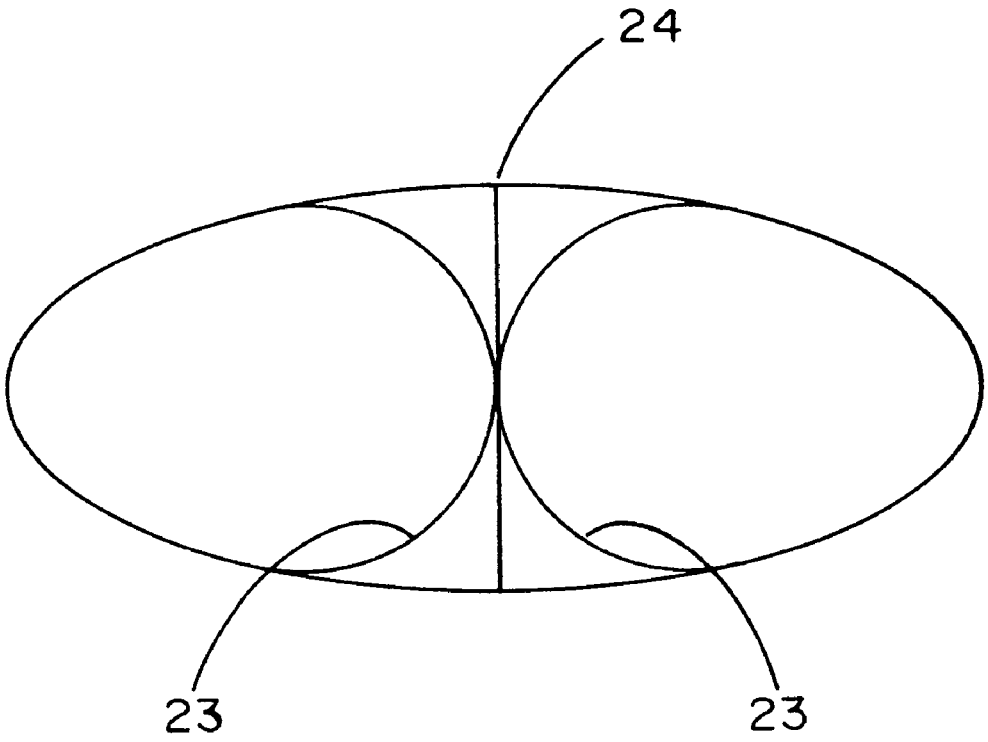
FIG. 3 is a plan schematic view of the pantyhose garment shown in FIG. 2.

The increased diameter of lower panty portion 24 formed by the pairing of the two blanks 16 like that described provides additional yarn and fabric at the critical location near the crotch of the garment where the two leg portions are commenced. A greater amount of fabric is required to encircle the two thigh portions 23 of the legs than is required to encircle the hip portion 48 just before the formation of the legs. This obvious requirement is illustrated best in FIG. 3 wherein the lower panty portion 24 is formed in a single tubular arrangement while the two thigh portions 23 are formed as two separate tubular members. Clearly, the amount of fabric required to form the two tubular members of the thigh portion exceeds the amount of fabric needed to form the single lower panty tubular portion. The ability to graduate stitches to increase diameter $d_2$ of blank 16 enables the provision of additional yarn and fabric to reduce yarn and fabric stress and provide more comfort to the wearer at the critical location. The fabric loss shown reflected in the drawings is a result of the joining seam (used to join opposing slit edges of each blank 16 together) which starts in a yarn wale wise or cross course downwardly direction along one slit edge and then gradually departs through a transition zone where it continues around the end of the slit in a cross wale direction until it then moves upwardly in a wale or cross course direction. The transition areas where the seam angularly extends over courses and wales is subtlety removing fabric so that a smaller diameter results in each of the blanks as fabric is removed. The provision of graduated stitches in the lower panty portion results in more yarn and fabric being provided to offset the loss of the yarn and fabric experienced during the seam sewing transition zones.

Upon completion of portion 24, a thigh graduation portion 26 is commenced and formed with a decreasing diameter $d_4$, and thereafter knee portion 28 having a constant diameter $d_5$ is formed and terminates with the commencement of a lower leg graduation portion 30 having a decreasing diameter $d_6$. After portion 30 is completed, ankle portion 32 is formed with a constant diameter $d_7$. Blank 16 is completed by the formation of an instep graduation portion 34 having an increasing diameter $d_8$ and foot portion 36 with a constant diameter $d_9$.

The selectively positioned increasing and decreasing diameter portions $d_2$, $d_4$, $d_6$ and $d_8$ are done gradually so that fabric density changes normally associated with abrupt graduation changes are avoided.

Also, forming a part of the present invention is a pantyhose garment shown generally as 38 formed by joining two blanks 16 like that previously described along edges 40 formed from slitting each blank in a longitudinal direction and joining the two blanks 16 along those cut edges. Additional and favorable fit and comfort characteristics may be added to the garment by the provision of a gusset 42 of a preselected size.

In summary, the invention provides a new construction for forming a hosiery blank and pantyhose therefrom that includes technology resulting in a configuration that contours to the shape of the body for a superior fit, particularly in the lower panty portion, but totally from the waist to the toe of the garment.

In the drawings and specification, there has been set forth the best mode presently contemplated for the practice of the present invention. Although specific terms are employed, they are used in the generic and descriptive sense only and not for purposes of limitation, the scope of the invention being defined in the claims.

What is claimed is:

1. A panty pantyhose combination garment having a waist portion formed from a pair of circularly knit blanks of yarn disposed in a side-by-side relationship and slit at least along part of their length and joined at pairs of the edges thus formed to provide a panty section with a front panty portion extending generally downwardly from the waist portion to the joined edges and a rear panty portion extending downwardly from the waist portion to the joined edges; leg portions extending from each of the blanks, the front and rear panty portions being gradually enlarged by elongated stitches at each blank proximate the location where the two legs commence to provide additional fabric and reduce the fabric and yarn stress at that location.

2. A panty pantyhose combination garment having a waist portion formed from a pair of circularly knit blanks of yarn disposed in a side-by-side relationship and slit at least along part of their length and joined at pairs of the edges thus formed to provide a panty section with a front panty portion extending generally downwardly from the waist portion to the joined edges and a rear panty portion extending downwardly from the waist portion to the joined edges; and a leg portion extending from each of the knit blanks at the joined edges of the front and rear formed panty portions, the front and rear panty portions being gradually enlarged in each blank proximate the location where each leg portion commences to provide additional fabric at the beginning of leg formation to reduce yarn and fabric stress at that location.

3. A panty pantyhose combination garment having a waist portion formed from a pair of circular knit blanks of yarn disposed in a side-by-side relationship and slit along at least part of their length and joined at pairs of the edges thus formed by sewing first along the wales on one side of the pairs of edges, then across the wales at the end of the slit edges and then upwardly toward the waist portion and with the wales to complete sewing and to provide a panty section with a front panty portion extending generally downwardly from the waist portion to the joined edges and a rear panty portion extending downwardly from the waist portion to the joined edges; and a leg portion extending from each of the knit blanks at the joined edges of the front and rear formed panty portion, the front and rear panty portions being gradually enlarged by elongated stitches in each blank proximate the location where each leg portion commences to provide additional fabric at the beginning of leg formation to reduce yarn and fabric stress at that location.

* * * * *

UNITED STATES PATENT AND TRADEMARK OFFICE

CERTIFICATE OF CORRECTION

PATENT NO. : 6,341,506 B1
DATED : January 29, 2002
INVENTOR(S) : Jonathan Myers

It is certified that error appears in the above-identified patent and that said Letters Patent is hereby corrected as shown below:

Title page,
Item [56], References Cited, U.S. PATENT DOCUMENTS, delete "2,948,065 A * 8/1960 Gift" and replace with -- 2,948,132 A * 8/1960 Gift --; and "3,595,132 A * 7/1971 Safrit" and replace with -- 3,595,034 A * 7/1971 Safrit --.

Column 3,
Line 46, delete "2" and replace with -- 24 --.

Signed and Sealed this

Twenty-first Day of January, 2003

JAMES E. ROGAN
*Director of the United States Patent and Trademark Office*